US006170654B1

(12) United States Patent
Gartner et al.

(10) Patent No.: US 6,170,654 B1
(45) **Date of Patent: *Jan. 9, 2001**

(54) CLOSURE CAP HAVING BLISTER PACK RUPTURABLE UPON OPENING OF CAP

(76) Inventors: Bradley Francis Gartner, 36 Taunton St., VIC 3109 East Doncaster (AU); Rickard Darrell Hansen, 15 Coolabah Groove, VIC 3806 Berwick (AU)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/219,735

(22) Filed: Dec. 22, 1998

Related U.S. Application Data

(63) Continuation of application No. PCT/AU97/00400, filed on Jun. 24, 1997.

(30) Foreign Application Priority Data

Jun. 27, 1996 (AU) ..... PO0705

(51) Int. Cl.[7] ..... B65D 25/08
(52) U.S. Cl. ..... 206/219; 206/222
(58) Field of Search ..... 206/219, 222, 206/221; 215/6, DIG. 8; 222/83, 129

(56) References Cited

U.S. PATENT DOCUMENTS

| | | | |
|---|---|---|---|
| 3,891,125 | 6/1975 | Morane et al. . | |
| 3,924,741 | 12/1975 | Kachur et al. . | |
| 4,024,952 | 5/1977 | Leitz . | |
| 4,065,037 * | 12/1977 | Haller | 222/153 |
| 4,132,308 | 1/1979 | Goncalves . | |
| 4,386,696 | 7/1983 | Goncalves . | |
| 4,399,158 | 8/1983 | Bardsley et al. . | |
| 4,682,689 * | 7/1987 | Pereira et al. | 206/222 |
| 4,927,065 | 5/1990 | Beck . | |
| 5,072,863 * | 12/1991 | Stull | 222/523 |
| 5,170,888 * | 12/1992 | Goncalves | 206/222 |
| 5,564,600 * | 10/1996 | Renault | 222/129 |
| 5,598,254 * | 1/1997 | Ikesue et al. | 222/129 |
| 5,638,968 * | 6/1997 | Baron et al. | 215/DIG. 8 |

FOREIGN PATENT DOCUMENTS

| | | |
|---|---|---|
| 847582 | 12/1982 | (AU) . |
| 37210/89 | 3/1990 | (AU) . |
| 1211168 | 11/1970 | (GB) . |
| 2211479 | 7/1989 | (GB) . |
| 8-091418 | 4/1996 | (JP) . |
| 92/084 | 5/1992 | (WO) . |
| WO 93/14990 | 8/1993 | (WO) . |
| 94/29216 | 12/1994 | (WO) . |

* cited by examiner

*Primary Examiner*—David T. Fidei
(74) *Attorney, Agent, or Firm*—Rader, Fishman, Grauer & McGarry an Office of Rader, Fishman and Grauer P.L.L.C.

(57) ABSTRACT

A closure cap having therein a blister pack in which an additive, which may be a tablet, is retained to be released into the liquid contents of an associated bottle simultaneously upon opening of the closure cap and the rupturing of said blister pack by part of a closure member and forming part of the closure cap, whereafter the contents of the container may be dispensed either through the closure cap or after removal of the closure cap.

24 Claims, 2 Drawing Sheets

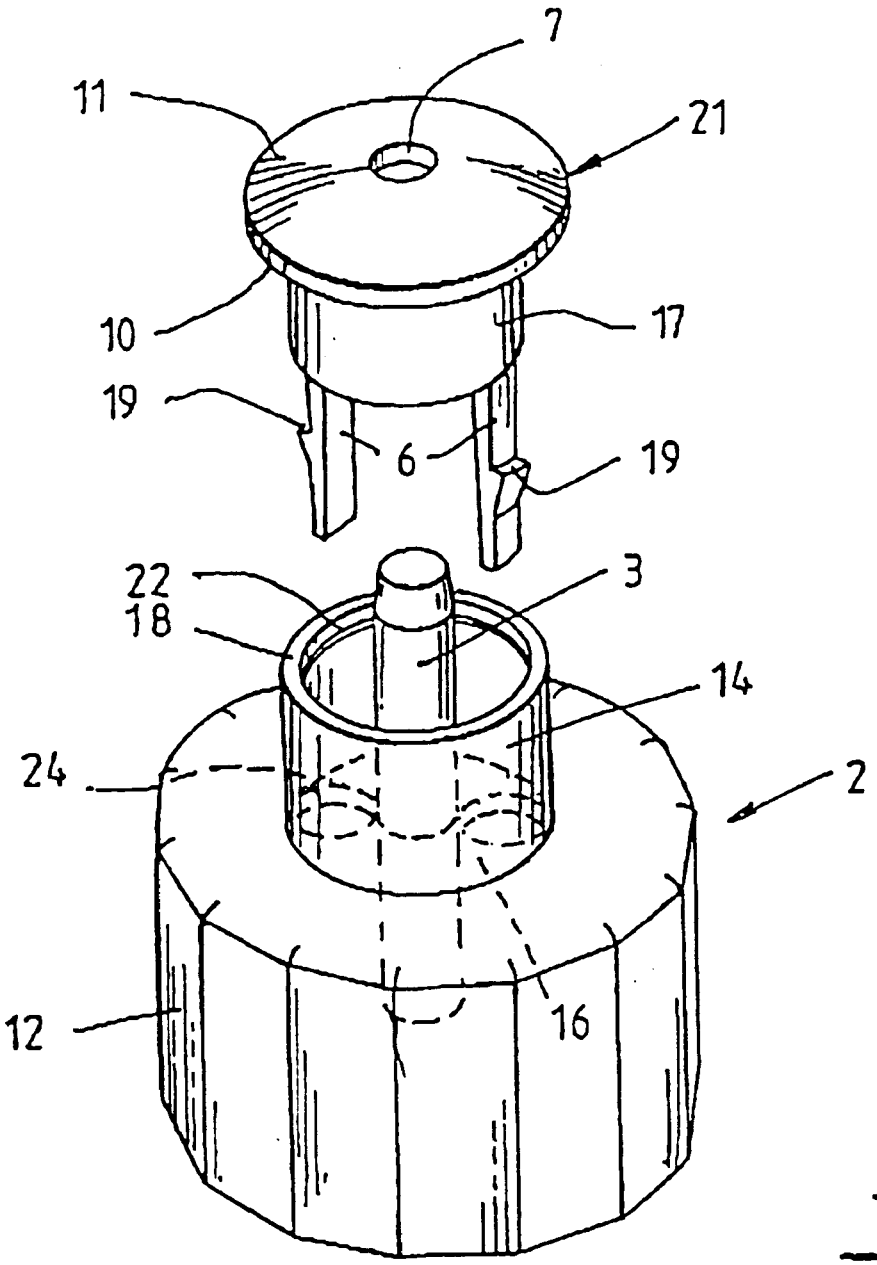
FIG. 3.
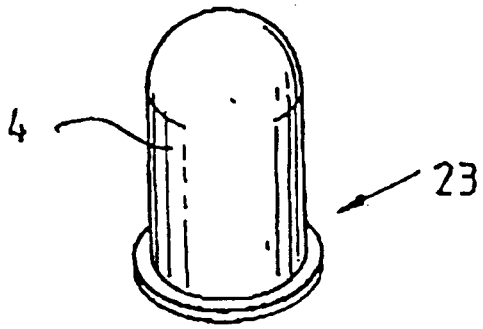

CLOSURE CAP HAVING BLISTER PACK RUPTURABLE UPON OPENING OF CAP

This application is a continuation of International Application No. PCT/AU97/00400, filed Jun. 24, 1997, and claims the benefit of the Australian Patent Application No. PO0705, filed Jun. 27, 1996.

BACKGROUND OF THE INVENTION

1. Field of the Invention

The present invention relates to a closure cap for a drink container, and a drink container carrying such a closure cap.

The closure cap of the present invention is to be associated with a drink container in which a base liquid is received and into which an additive is to dispensed. The additive, may be a vitamin and/or electrolyte supplement as may be consumed by a sportsperson, or an antacid or stomach settling compound, and either in liquid, powdered or dissolvable tablet form.

The primary object of the invention is to retain the additive in the closure and isolate it from the base liquid until such time as the drink is to be consumed, at which time the additive is released into the base liquid.

2. Related Art

It is known to provide a closure cap for a container which allows two substances to be mixed to form a single composite product. Such containers are often used in dentistry or medicine to keep two reagents separate until they are to be used. AU-37210/89 discloses a cap with a push-button that releases an additive when pressed. The composite product is subsequently dispensed by unscrewing the closure cap. U.S. Pat. No. 4,132,308 discloses a screw cap which mixes two substances when the cap is rotated.

It is also known to provide drink containers which allow the combination of two ingredients. GB 2211479 discloses a device for storing mixed drinks where the ingredients are stored in two separate compartments separated by a partition which is ruptured by a punch prior to consumption. U.S. Pat. No. 4,399,158 discloses a container in which an additive is secured within a holder which is held closed by internal pressure until the can is opened at which time the additive is released into the beverage. AU 84745182 discloses a dual compartment beverage container wherein the dividing diaphragm is ruptured by the interaction of a drinking straw with a cutting tool.

SUMMARY OF THE INVENTION

In accordance with the invention there is provided a closure cap having a compartment in which an additive is retained and adapted to be released into the liquid contents of an associated container simultaneously upon opening of the closure cap, the closure cap having a closure means which incorporates a push-pull mechanism movable relative to a body portion of the closure cap, whereby the cap Is opened by pulling a first portion of the closure means to an open position, whereafter the contents of the container may be dispensed through an aperture in said first portion, and wherein the closure cap may be closed by pushing said first portion to a closed position, whereafter spillage of the contents of the associated bottle will not occur.

One advantage of incorporating the means for retaining the additive in the closure cap is that the device may be used in conjunction with a standard drink bottle, hence reducing production costs. A further advantage is that causing mixing and allowing dispensing may be achieved by the same action.

In a preferred embodiment of the invention the closure cap is used in conjunction with a carbonated or still colorless drink product contained in a clear bottle. A tablet is retained within the closure cap which effervesces when released into the drink product. The tablet may typically contain color, flavor, vitamin substitutes, non-prescription medication or a combination thereof, which are mixed with the base liquid of the drink product by the effervescing of the tablet and by shaking the bottle. Also, there is the opportunity to keep the flavoring, coloring, vitamins or medicines separate from the drink until the moment of consumption hence allowing flavors, colors, vitamins or medicines which would normally not keep for a long duration to be used, or alternatively to reduce the amount of preservative used in the drink product.

BRIEF DESCRIPTION OF THE DRAWINGS

One preferred embodiment of the invention will now be described with references to the accompanying drawings, in which;

FIG. 3 is an exploded perspective view of some of the components of the closure cap of FIGS. 1 and 2.

DETAILED DESCRIPTION

Figure 2:
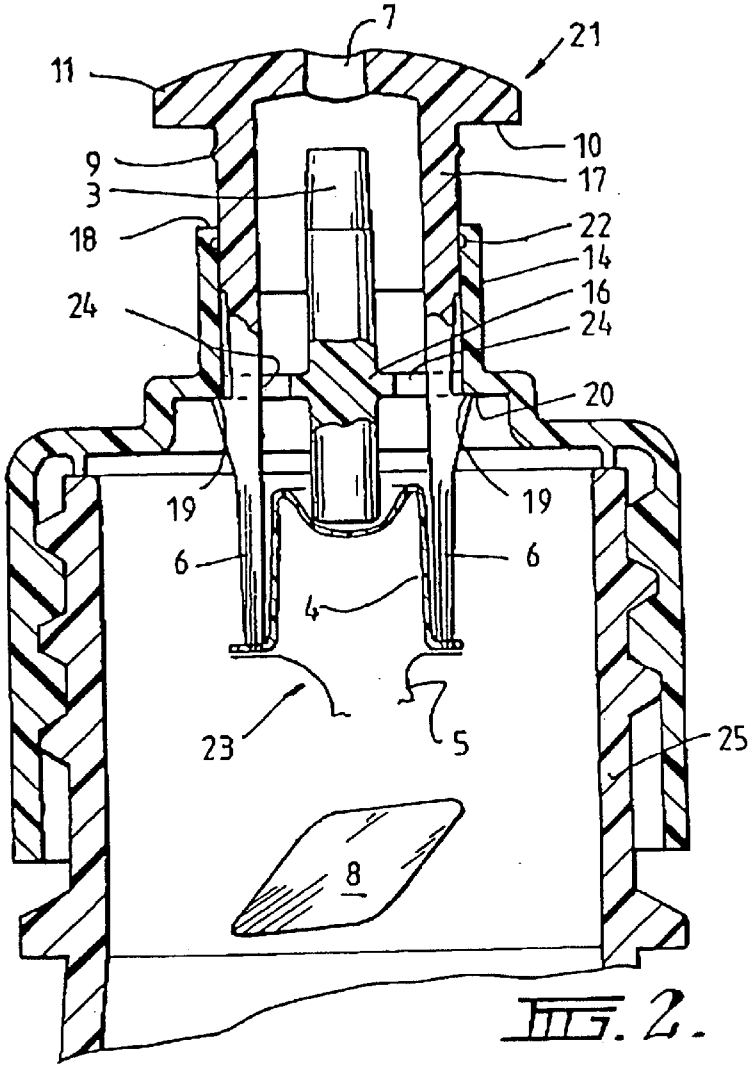
FIG. 2 is a longitudinal cross-sectional view of the closure cap of FIG. 1, but in the process of actuation to release an additive into the base liquid contents of the bottle, and to allow dispensing or consumption of the liquid contents of the associated bottle.
Figure 1:
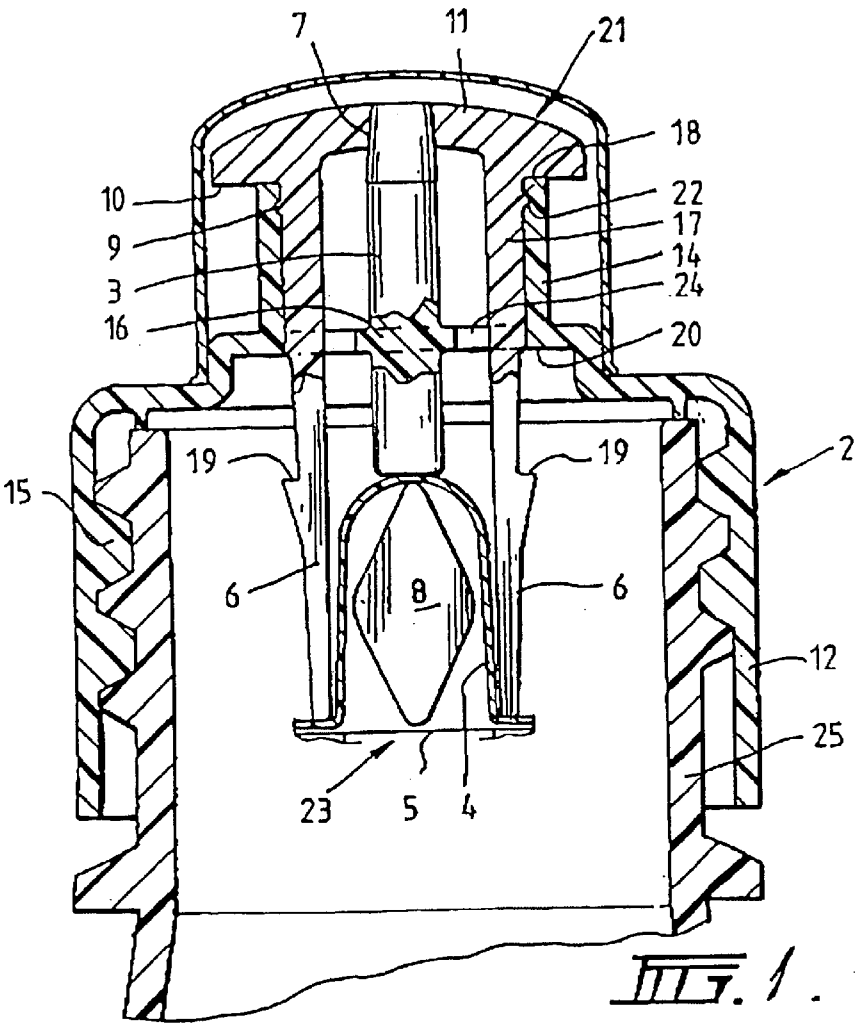
FIG. 1 is a longitudinal cross-sectional view through the closure cap of this preferred embodiment of the invention and in a preliminary condition as applied to the neck of a drink container, such as a neck of a plastics or glass bottle.

With reference to the drawings, in this preferred embodiment the closure cap comprises a screw cap 2; a closure member 21; and a blister pack 23 containing a tablet 8. The screw cap 2 is adapted to be screwed onto the neck of a bottle 25 in the conventional manner and is preferably made from a recyclable plastic material. The screw cap 2 is constructed in a stepped cylindrical manner with two or more cylindrical sections. The bottom cylindrical section 12 contains the screw thread 15 and is dimensioned to correspond with the bottle. The top cylindrical section 14 is of a smaller diameter. The screw cap also includes a central pillar 3 which sits within the neck of the bottle and which is formed integrally with the screw cap. The pillar 3 is attached to the bottom 16 of the top cylindrical section either by spoken or by a disc with cut out portions 24. The pillar 3 extends above and below the attachment point 16 and its circumference in dimensioned to correspond with the inner circumference of an aperture 7 through the closure member and it extends to a distance above the attachment point which allows it to fully close the aperture 7 when the closure member 21 in the closed position. The closure member 21 is slidably movable between a cloned and an open position.

The main features of the closure member 21 are: a mouthpiece portion 11; a cylindrical section 17; and two or more leg sections 6. The mouthpiece portion 11 in at the top Of the closure member 21 and has an upper surface which in slightly curved in order to allow the top of the aperture to extend into the consumer's mouth when the consumer's lips are in contact with the mouthpiece. The aperture 7 is dimensioned to control the volume Of liquid which flows in a given time period. The mouthpiece portion also has a flange 10 which extends beyond the outer circumference of the top cylindrical section 14 of the screw cap member 2. The bottom surface of the flange 10 allows the consumer to grip the closure member 21 and provides a surface area onto which force may be applied when moving the closure member 21 to the open position.

The mouth piece 11 in formed integrally with the cylindrical section 17 which is dimensioned so that when the closure 21 member in the closed position the flange 16 rests on top 18 of the screw cap member whilst the bottom of the cylindrical section rests on the spokes 24 which Join the central pillar 3 to the rest of the screw cap. The cylindrical section 17 of the closure member 21 fits within the top cylindrical section 14 of the screw cap 2 and has a raised ridge area 9 designed to fit within a corresponding indentation 22 within the top cylindrical section 14 of the screw cap. The ridge/indentation combination are provided to stop the lid member accidentally moving from the closed to open positions. The ridge/indentation combination are sized such that the lid member cannot move freely but can be easily moved by application of force such an can reasonably be applied by hand.

Two or more legs 6, in this case two diametrically opposed legs, extend from the bottom of the cylindrical section through the cut out portions of the disc 24 which attaches the central pillar 3 to the screw cap 2. The legs 6 have tapered shoulders 19 which restrict the travel of the lid member when it is opened and when the top surface of the shoulder contacts the underside of the top of the middle cylindrical section 20 of the screw cap member.

The blister pack 23 consists of a deformable dome 4 which has a frangible seal 5 as its base. The blister pack 23 is attached to the lower section of the legs 6 at a distance which allows the top of the dome of the blister pack to reside just below the central pillar when the closure member is in the closed position. When the closure member in moved towards the Open position the dome contacts the pillar and deforms inwardly which subsequently applies sufficient force on the tablet 8 to cause it to rupture the frangible seal 5 and to drop into the liquid contained in the bottle. To ensure that the blister pack 23 is effectively ruptured the distance which the closure member 21 travels from the closed to open positions must be considered in relation to the distance the legs 6 extend below the bottom of the pillar 3, the distance to which the pillar extends below the attachment point 16, and the size of the blister pack.

What is claimed is:

1. A closure cap having a compartment for retaining an additive, the closure cap having a first portion and a body portion defining a push-pull mechanism, said first portion having an aperture, whereby opening of the closure cap is achieved by pulling said first portion of the closure cap relative to said body portion to an open position without said first portion being rotated relative to said body portion, and any additive in said compartment is simultaneously released from the compartment, whereby, in use, any such additive is released into an associated container having liquid contents, whereafter the liquid contents of the associated container may be dispensed through the aperture in said first portion, and wherein closing of the closure cap is achieved by pushing said first portion relative to said body portion to a closed position in which said aperture is closed, whereafter spillage of the contents of the associated container will not occur.

2. A closure cap as claimed in claim 1, further comprising a second portion which is fixed relative to said body portion and which closes the aperture when said first portion is pushed to the closed position.

3. A closure cap as claimed in claim 2, wherein said second portion engages the compartment as said first portion is pulled towards the open position, thereby causing any additive therein to be released.

4. A closure cap as claimed in claim 3, wherein said second portion is an axial post joined to said body portion of the closure cap by a plurality of struts, the body portion, the struts and the axial post defining a plurality of secondary apertures through which the liquid contents may pass.

5. A closure cap as claimed in claim 4, wherein said first portion has at least two legs extending therefrom and connected to the compartment.

6. A closure cap as claimed in claim 2, wherein said second portion is an axial post joined to said body portion of the closure cap by a plurality of struts, the body portion, the struts and the axial post defining a plurality of secondary apertures through which the liquid contents may pass.

7. A closure cap as claimed in claim 1, wherein said first portion has at least two legs extending therefrom and connected to the compartment.

8. A closure cap as claimed in claim 2, wherein said first portion has at least two legs extending therefrom and connected to the compartment.

9. A closure cap as claimed in claim 3, wherein said first portion has at least two legs extending therefrom and connection to the compartment.

10. A closure cap as claimed in claim 5, wherein said at least two legs have shoulder portions which abut an inner surface of said body portion when said first portion is in the open position, thereby preventing the first portion from being detached from the closure cap.

11. A closure cap as claimed in claim 4, wherein said first portion has at least two legs extending therefrom and connected to the compartment.

12. A closure cap as claimed in claim 5, wherein said first portion has at least two legs extending therefrom and connected to the compartment.

13. A closure cap as claimed in claim 10, wherein said first portion has at least two legs extending therefrom and connected to the compartment.

14. A closure cap as claimed in claim 1 in combination with a container.

15. The combination of a closure cap and a container as claimed in claim 14, wherein the container is a bottle with a neck and said closure cap is screw-threaded onto the neck of said bottle.

16. A closure cap as claimed in claim 1 in combination with an additive.

17. The combination of a closure cap and an additive as claimed in claim 16, wherein the additive is a tablet.

18. The combination of a closure cap and a container as claimed in claim 14, in combination with an additive.

19. The combination of claim 18, wherein the additive is a tablet.

20. A closure for a container, the closure having a compartment for holding an additive fluidly isolated from the container by a frangible membrane, a first portion and a body portion, wherein the first portion has an aperture that is sealed by the body portion in a closed position, and wherein non-rotational, axial movement of the first portion away from the body portion to an open position unseals the aperture and forces the additive into and through the frangible membrane to fluidly connect the compartment with the container and release the additive into the container.

21. The closure of claim 20, wherein the container is fluidly connected with the aperture.

22. The closure of claim 21, wherein non-rotational, axial movement of the first portion toward the body portion from the open position to the closed position seals the aperture.

23. In combination, a closure cap and a container, the closure having a compartment for holding an additive fluidly isolated from the container by a frangible membrane, a first portion and a body portion, wherein the first portion has an aperture that is sealed by the body portion in a closed position, and wherein non-rotational, axial movement of the first portion relative to the body portion to an open position unseals the aperture and forces the additive into and through the frangible membrane and into the container.

24. The combination of claim 23, wherein the container is fluidly connected to the aperture and contents of the container may be dispensed through the aperture in the open position, and wherein the container is sealed by the closure cap in the closed position.

* * * * *

UNITED STATES PATENT AND TRADEMARK OFFICE

CERTIFICATE OF CORRECTION

PATENT NO.: 6,170,654

DATED: January 9, 2001

INVENTORS: Gartner et al.

It is certified that error appears in the above-identified patent and that said Letters Patent is hereby corrected as shown below:

Claim 10, column 4, line 29, "closure cap" should read --body portion--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,170,654 B1
DATED : January 9, 2001
INVENTOR(S) : Gartner et al.

It is certified that error appears in the above-identified patent and that said Letters Patent is hereby corrected as shown below:

Title page,
Item should read: Bradley Francis Gartner, 36 Taunton St., VIC 3109
[76] Inventors, East Doncaster (AU);
Rickard Darrell Hansen, 15 Coolabah Grove, VIC 3806
Berwick (AU)

Column 2,
Line 48, "spoken" should read -- spokes --;
Line 50, "in" should read -- is --;
Line 54, insert "is" after "21";
Line 55, "cloned" should read -- closed --;
Line 58, "in" should read -- is --;
Line 60, "in" should read -- is --;

Column 3,
Line 4, "in" should read -- is --;
Line 6, insert "is" after "member";
Line 18, "an" should read -- as --;
Line 33, "in" should read -- is --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*